US007071631B2

(12) United States Patent
Howard, II

(10) Patent No.: US 7,071,631 B2
(45) Date of Patent: Jul. 4, 2006

(54) ELECTROMAGNETIC PULSE DEVICE

(75) Inventor: James Millington Howard, II, Mt. Airy, MD (US)

(73) Assignee: Bio-Reg Associates, Inc., Beltsville, MD (US)

( * ) Notice: Subject to any disclaimer, the term of this patent is extended or adjusted under 35 U.S.C. 154(b) by 0 days.

(21) Appl. No.: 10/444,293

(22) Filed: May 23, 2003

(65) Prior Publication Data

US 2004/0232847 A1 Nov. 25, 2004

(51) Int. Cl.
*H05B 37/00* (2006.01)

(52) U.S. Cl. ..... 315/236; 315/348; 307/108

(58) Field of Classification Search ..... 315/111.01, 315/111.81, 236, 244, 344, 348, 349, 111.21, 315/111.41, 111.51; 307/106, 108; 102/202.8, 102/202.14, 200

See application file for complete search history.

(56) References Cited

U.S. PATENT DOCUMENTS

| | | | | |
|---|---|---|---|---|
| 4,442,383 | A * | 4/1984 | Hill | 315/349 |
| 4,660,014 | A * | 4/1987 | Wenaas et al. | 336/84 C |
| 5,052,301 | A * | 10/1991 | Walker | 102/202.7 |
| 5,608,380 | A * | 3/1997 | Hogen Esch | 340/572.3 |
| 6,005,305 | A * | 12/1999 | Turchi | 307/106 |
| 6,477,932 | B1 * | 11/2002 | Jung | 89/1.11 |

FOREIGN PATENT DOCUMENTS

DE 3323304 A1 * 1/1988

OTHER PUBLICATIONS

Wilson, "The E-Bomb," Popular Mechancis, www.popularmechanics.com, pp. 50-53 (Sep. 2001).
Kopp, "A Doctrine for the Use of ElectroMagnetic Pulse Bombs (Revised Draft of RAAF APSC Working Paper #15, Jul. 1993," *EMP Doctrine,* pp. 1-15, (Jul. 1993).
Fernstermacher, et al. "An Atmospheric Limit On Nuclear-Powered Microwave Weapons," *Science & Global Security,* 2:301-324 (1991).
Kunabenchi, et al., "Simple Nitrogen Laser," *Am. J. Phys.,* 50:6, pp. 568-569 (Jun. 1982).
Kruszelnicki, "EMP-The Gentle Killer 3," *Karl S. Kruszelnicki Pty Ltd.,* pp. 1-3 (2001).
International Search Report, 2 pages, mailing date Mar. 2, 2005.
Written Opinion of International Searching Authority, 6 pages, mailing date Mar. 2, 2005.

* cited by examiner

*Primary Examiner*—Thuy Vinh Tran
(74) *Attorney, Agent, or Firm*—Schnader Harrison Segal & Lewis, LLP; Joan T. Kluger

(57) ABSTRACT

An electromagnetic pulse device having a conductive coil, and optionally a conductive core disposed within the coil and spaced apart there from. One or more plasma discharge devices are disposed at least partially along a length of the conductive coil and are spaced apart from the conductive coil. A spark gap or similar device is attached to the plasma discharge devices to activate them to produce a traveling electric discharge. The discharge creates a traveling short circuit in the conductive coil thereby compressing the magnetic field. The result is the production of an electromagnetic pulse. Further disclosed is a method for producing an electromagnetic pulse.

29 Claims, 3 Drawing Sheets

ELECTROMAGNETIC PULSE DEVICE

FIELD OF THE INVENTION

The invention relates to electromagnetic pulse devices.

BACKGROUND OF THE INVENTION

An intense electromagnetic pulse (EMP) of short duration produces a strong electromagnetic field surrounding the pulse source. A particularly strong electromagnetic field can produce transient voltages on unprotected or poorly protected electrical conductors. Such an occurrence is likely to permanently damage electrical devices or cause them to malfunction either temporarily or permanently. Any device containing metal oxide semiconductors, such as computers and telecommunications equipment, is particularly susceptible to damage from an electromagnetic pulse. Accordingly, a device generating an EMP pulse can be used to intentionally disable electronic equipment. This can have military applications, but may also have other applications, particularly when implemented on a small, controlled scale.

An EMP device can be fabricated by filling a metal cylinder with an explosive material. A conductive coil is formed around, but slightly apart from, the cylinder. A current is applied to the coil to create a magnetic field. The explosive material is then ignited at one end and explodes, thereby expanding the cylinder. The explosion continues to expand the cylinder as it moves along the cylinder length. As the cylinder expands, it contacts the coil creating a traveling short circuit. The magnetic field is compressed by the short circuit, and energy from the explosive is transferred to the magnetic field, causing an increasing current pulse. This design can create electromagnetic radiation of sufficient strength to damage electrical devices.

EMP devices, such as described above, will create radiation having frequencies on the order of one MHz or less. Radiation at these frequencies is typically emitted in all directions and cannot be focused on a specific target. In addition, the explosion required to initiate the electromagnetic pulse can cause significant damage. These effects make the damage caused by the device difficult to control. Additionally, the EMP pulse may damage the device itself before it is fully detonated. Therefore, a need exists for an EMP device capable of producing radiation that does not require explosive material, that is not susceptible to premature destruction and that can produce radiation which can be directionally controlled.

SUMMARY OF THE INVENTION

An EMP device is disclosed. The device includes a conductive coil, and optionally a conductive core disposed within the coil and spaced apart therefrom. One or more plasma discharge devices are disposed at least partially along a length of the conductive coil and are spaced apart from the conductive coil. A spark gap or similar device is attached to the plasma discharge devices to activate them to produce a traveling electric discharge. The discharge creates a traveling short circuit in the conductive coil thereby compressing the magnetic field. The result is the production of an electromagnetic pulse. Further disclosed is a method for producing an electromagnetic pulse.

DESCRIPTION OF THE DRAWINGS

The invention is best understood from the following detailed description when read with the accompanying drawings.

DETAILED DESCRIPTION OF THE INVENTION

Embodiments of the invention provide an EMP device having an electro-discharge shorting mechanism. In its broadest sense, the invention covers EMP devices having a non-explosive material shorting mechanism. This type of shorting mechanism may enable generation of higher frequency electromagnetic pulses than is currently possible with traditional, explosive-containing shorting mechanisms.

Figure 1:
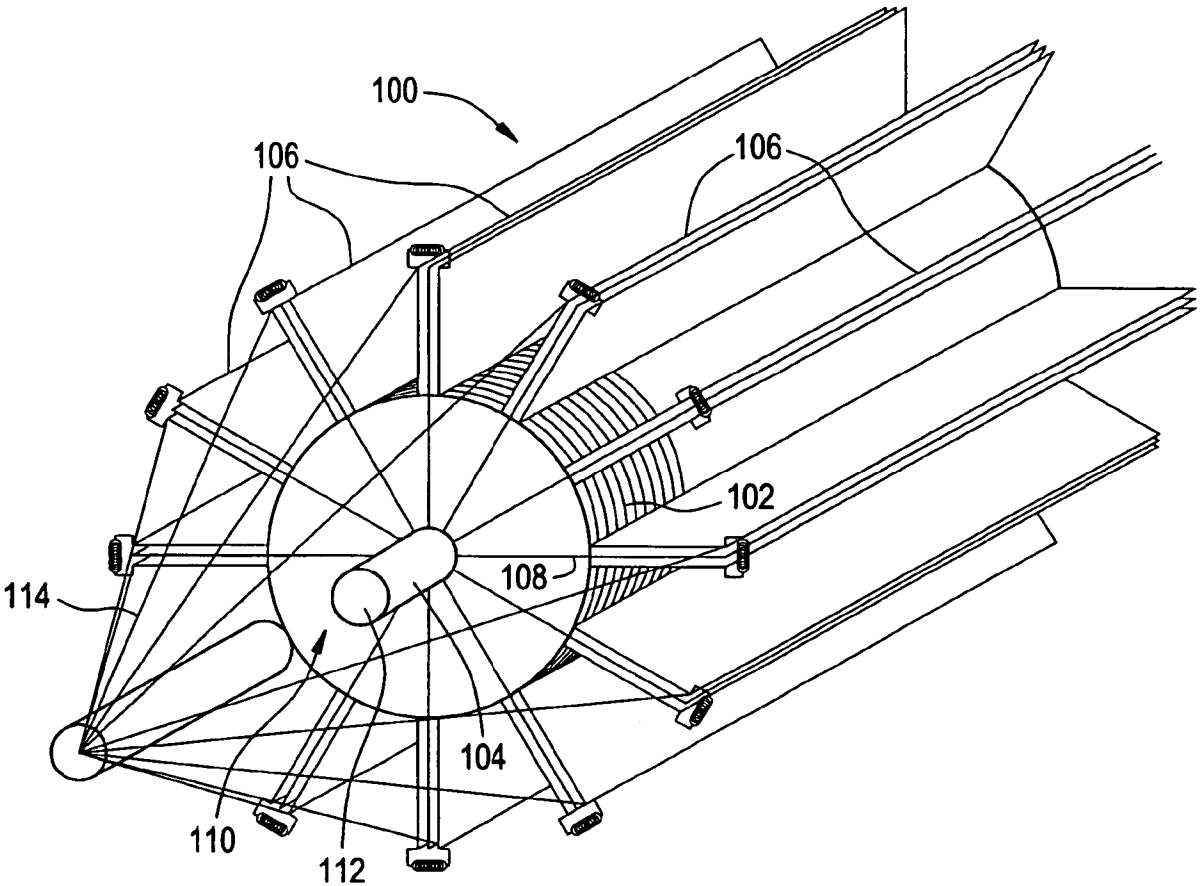
FIG. 1 depicts an illustrative embodiment of an electromagnetic pulse device.

FIG. 1 depicts an illustrative embodiment of an EMP device 100. When energized, conductive coil 102 produces a magnetic field. FIG. 1 depicts an optional conductive core 104 disposed within conductive coil 102. Conductive core 104 is preferably metallic, and may be iron for example. In a further embodiment of the invention an external conductor may be included. Whether external or as a core, the conductor can provide a ground return path for a spark gap, details which will be described below. One or more plasma discharge devices 106 are disposed at least partially along a length of conductive coil 102 and spaced apart from it. Preferably, the plasma discharge devices 106 are spaced apart from conductive coil 102 approximately 5 mils ($12.5\times10^{-5}$ m). In an exemplary embodiment, the spacing is in a range of about $5.0\times10^{-5}$ m to about $5.0\times10^{-2}$ m. The plasma discharge devices 106 create a traveling short circuit of the coil which compresses the magnetic field, and thus creates an electro-magnetic pulse.

A spark gap 110 is positioned such that when activated by a current, the plasma discharge devices 106 create the electric discharge that triggers the electromagnetic pulse production, as will be explained further below. Devices or configurations of components other than spark gaps, or equivalents thereto, may be used to activate the plasma discharge devices 106 and are within the spirit and scope of the invention.

Preferably all plasma discharge devices 106 are activated by the same spark gap. One such configuration is shown in FIG. 1. Spark gap 110 is formed by a grounded end 104. The other side of single spark gap 110 is connected to all plasma discharge devices 106 by conductive connectors, such as 108 and 114. Such conductive connectors as 108 and 114 may be for example, metal rods. Conductive connectors such as 108 connect the grounded end of spark gap 110 to each of the plasma discharge devices 106. Conductive connectors such as 114 link a high voltage section of plasma discharge devices 106 to spark gap 110. In the embodiment shown in FIG. 1, the electric discharge is created along an edge of each plasma discharge device 106 adjacent to conductive coil 102.

Preferably conductive connectors such as 114 converge at a common point/area so that current may be supplied substantially simultaneously to each plasma discharge device. Other configurations allowing for simultaneous current supply are also within the scope of the invention. FIG. 1 shows conductive connectors such as 114 converging in a substantially conical shape which is the preferred configuration. This shape may be advantageous as lengths of connectors such as 114 can be uniform, thus allowing simultaneous activation of the plasma discharge devices 106. Non-simultaneous current supply (e.g. non-simultaneous activation of the plasma discharge devices 106) is also within the scope of the invention.

In an exemplary embodiment, plasma discharge devices 106 are arranged at substantially equal degrees around conductive coil 102. An illustrative number of plasma discharge devices 106 is in the range of 1 to 20, with the preferred number being 12.

Figure 2:
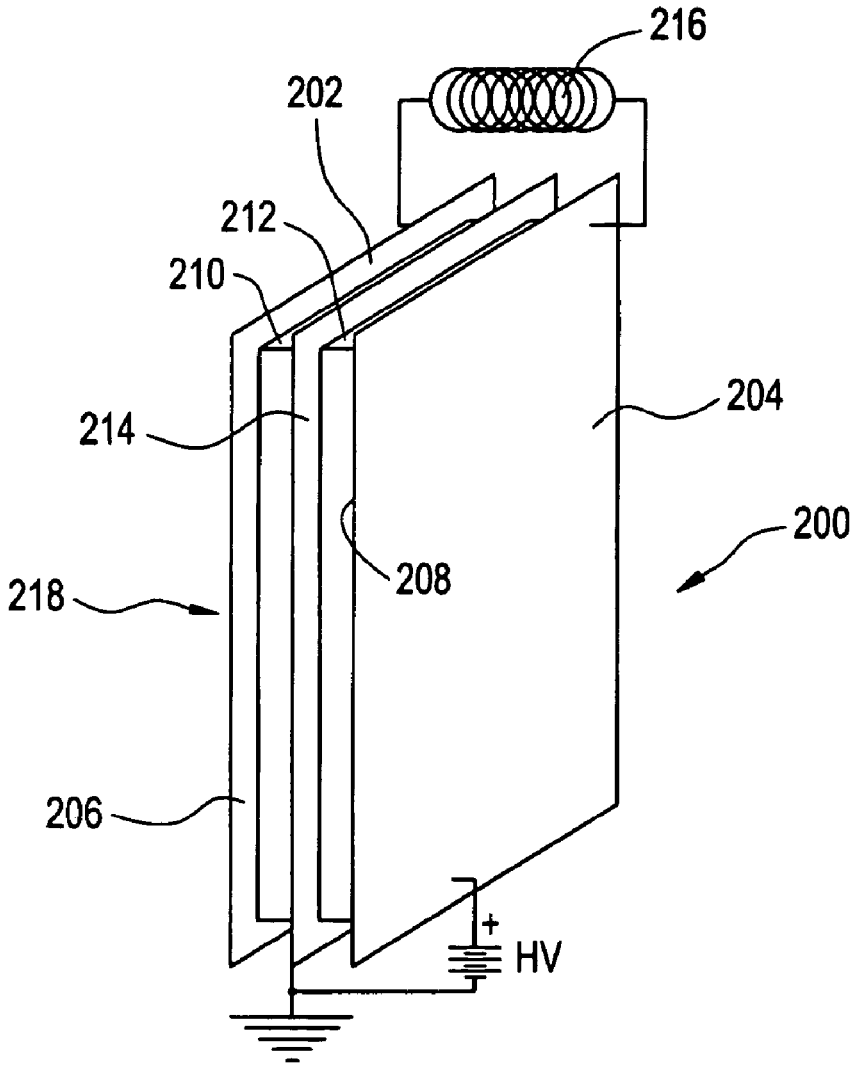
FIG. 2 depicts an illustrative embodiment of the plasma discharge device.

One or more of plasma discharge switches 106 may be constructed as those shown in FIG. 2 which have parallel plate capacitors. As used herein, a "plate" is not limited to a rigid layer or to any particular thickness. FIG. 2 depicts an illustrative embodiment of a plasma discharge device 200 shown in the form of two parallel plate capacitors. Plasma discharge device 200 has a first outer electrically conductive plate 202 and a second outer electrically plate 204. Plates 202 and 204 each have an inside face 206 and 208, respectively. A first electrically insulating plate 210 is adjacent to first outer plate inside face 206, and a second electrically insulating plate 212 is adjacent to second outer plate inside face 208. Insulating plates 210 and 212 may be fiberglass for example. An inner electrically conductive plate 214 is disposed between first electrically insulating plate 210 and second electrically insulating plate 212. First outer electrically conductive plate 202 is electrically connected to second outer electrically conductive plate 204 by a plate-connecting component 216, such as a conductive coil.

Plasma discharge device 200 may be utilized in the present invention by applying a voltage to outer electrically conductive plate 204 while grounding inner plate 214 to create a potential difference therebetween. Because the first and second outer electrically conductive plates 202 and 204 are initially charged to the same potential, no potential difference exists between them. As noted above, a spark gap can be used to initiate a discharge of the plasma discharge device along its length. A current is initiated across the spark gap when a threshold voltage is applied to the plasma discharge device. When plasma discharge device 200 is activated, the outer conductive plate 204 is at a higher voltage relative to outer conductive plate 202. An electric-discharge is thus created along edge 218 that travels at nearly the speed of light. This discharge creates a plasma between plasma discharge device 200 and the coil of the EMP device thereby short-circuiting the coil. This will compress a magnetic field that is present if the coil is energized. The compressed magnetic field generates electromagnetic radiation.

Although a spark gap is described herein, any triggering device capable of initiating a discharge of the plasma discharge devices and compatible therewith, is within the spirit and scope of the invention.

Figure 3:
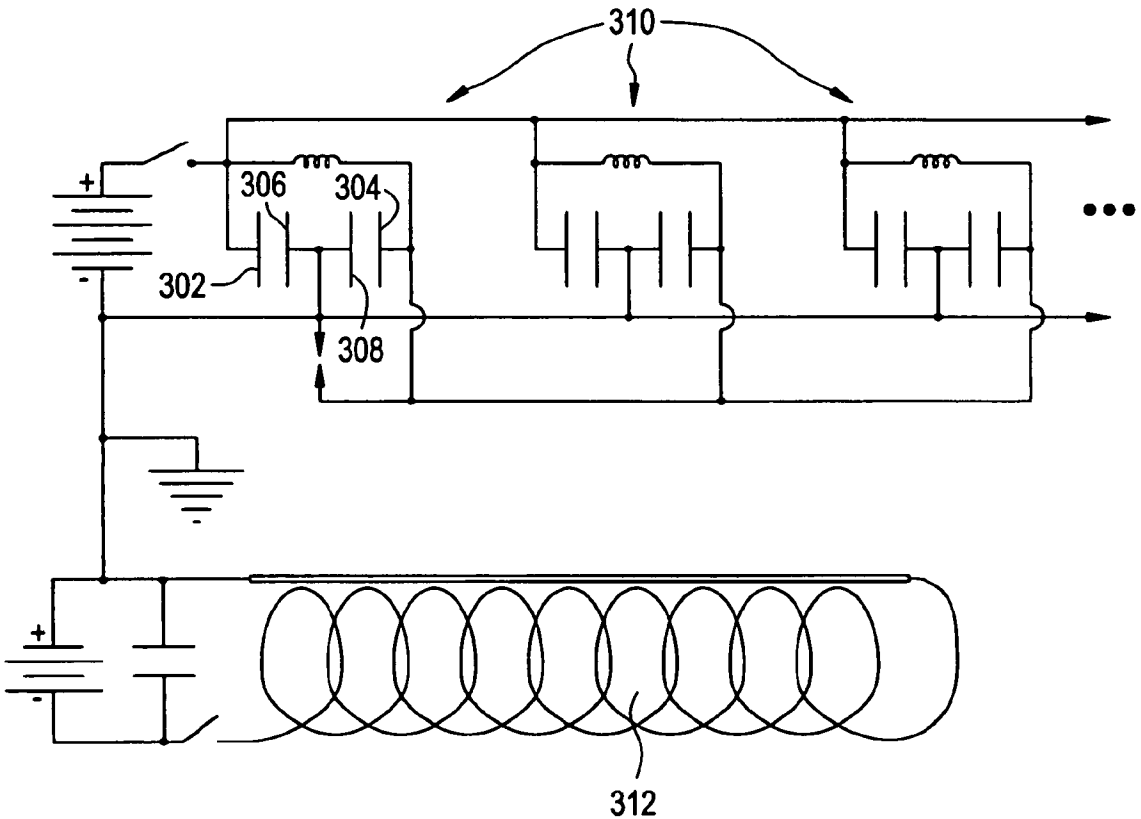
FIG. 3 depicts circuitry for an electromagnetic pulse device according to an illustrative embodiment of the invention.

FIG. 3 depicts a circuit diagram that illustrates parallel plate capacitors forming a plurality of plasma discharge devices 310. Further illustrated is a conductive coil 312 having a voltage applied thereto to create a magnetic field.

The configuration of plates depicted in FIG. 3 is analogous to two interconnected capacitors. Discharge of one of the outer plates of a pair of parallel plate capacitors within a plasma discharge device, such as plate 304 with plate 308, results in an arc between two outer plates, such as plates 302 and 304. This is analogous to an electric-discharge traveling along edge 218 of the plasma discharge device 200. The arc shorts conductive coil windings 312 to ground, creating a flux compression, and hence producing an electromagnetic pulse. Additional or alternative circuitry may be used, for example to synchronize capacitor discharge into the coil with firing of the plasma discharge devices.

Illustrative voltage ranges are as follows: Voltage across an electro-discharge device is preferably in the range of about 15–30 KV. A potential applied to the coil to create a magnetic field is preferably in the range of about 1–3 KV. Voltages may range above or below these values to assure proper operation.

The frequency of the electromagnetic radiation, assuming a 25 cm coil length with 150 turns, can be calculated as follows:

$$\text{frequency} = \left(\frac{l}{c}\right)^{-1} = \frac{3.8\times10^{10}\ \text{cm/sec}}{25\ \text{cm}} = 1.5\times10^{9}\ \text{Hz} = 1.5\ \text{GHz}$$

This is a higher frequency than the MHz frequency produced by traditional explosive material-containing EMP devices.

To optimize the performance of the inventive EMP device, numerous parameters may be varied. The parameters include, but are not limited to, coil length, coil diameter, number of coil turns, component materials, component dimensions, voltages applied, and currents applied. Additionally, the device may contain one or more superconductive components, such as, but not limited to, the coil.

The inventive EMP device may further include a non-magnetic insulation component disposed around the conductive coil and plasma discharge devices. The device may also be surrounded by a stability-enhancing component such as a cooling device. As an example, a gas such as nitrogen, or a mixture of gases, may be used to cool or stabilize the electro-discharge device arc.

Still further, a parabolic reflector may be included and positioned so that radiation is emitted from the EMP device substantially at the focus of the parabolic reflector, thereby directing emitted radiation to a limited area. This may be advantageous to maximize output intensity of the EMP device and to protect users or objects from its effects.

The scope of the invention also includes an EMP device comprising a plurality of individual EMP devices. Each electro-magnetic device may be activated by current generated from another of the electromagnetic devices, or may be activated by another means, either simultaneously or in succession with the other electromagnetic devices. In an illustrative embodiment of the invention, the plurality of EMP devices is cascaded. In a further embodiment, the plurality of devices is activated in parallel. A combination of cascaded and parallel devices may also be implemented.

The present invention further includes combining an EMP device having explosive material with plasma discharge devices. In an exemplary embodiment, current generated from the electro-discharge device activates the explosive material.

The invention further includes a method of generating an electromagnetic pulse comprising forming a conductive coil around, but separated from, a conductive core, applying a current to the conductive coil to produce a magnetic field, and shorting the conductive coil with a plasma discharge device. The conductive core may be metallic for example.

While the invention has been described by illustrative embodiments, additional advantages and modifications will occur to those skilled in the art. Therefore, the invention in its broader aspects is not limited to specific details shown and described herein. Modifications, for example, to the number of plasma discharge devices and the specific configuration of the electromagnetic device components may be made without departing from the spirit and scope of the invention. Accordingly, it is intended that the invention not be limited to the specific illustrative embodiments, but be interpreted within the full spirit and scope of the appended claims and their equivalents.

The invention claimed is:

1. An electromagnetic pulse device comprising:

a conductive coil; and one or more plasma discharge devices, each disposed at least partially along a length of the conductive coil and spaced apart from the conductive coil;

wherein the one or more plasma discharge devices create a plasma between the one or more plasma discharge devices and the conductive coil, thereby short-circuiting the coil to generate electromagnetic radiation.

2. The electromagnetic pulse device of claim 1 further comprising a triggering device attached to the one or more plasma discharge devices.

3. The electromagnetic pulse device of claim 2 wherein the triggering device is a spark gap.

4. The electromagnetic pulse device of claim 1 further comprising one or more conductive connectors, each connected to one or more plasma discharge devices, for carrying an activation current to the plasma discharge devices.

5. The electromagnetic pulse device of claim 4 wherein the one or more conductive connectors converge on a common area.

6. The electromagnetic pulse device of claim 4 wherein the one or more conductive connectors converge in a substantially conical shape.

7. The electromagnetic pulse device of claim 1 further comprising one or more electrical connectors connecting the one or more plasma discharge devices to a conductive core.

8. The electromagnetic pulse device of claim 1 wherein the one or more plasma discharge devices are arranged at substantially equal degrees around the conductive coil.

9. The electromagnetic pulse device of claim 1 wherein at least one of the one or more plasma discharge devices is a plasma discharge device.

10. The electromagnetic pulse device of claim 1 wherein at least one of the one or more plasma discharge devices comprises a parallel plate capacitor.

11. The electromagnetic pulse device of claim 1 wherein each of the one or more plasma discharge devices comprises:

a first outer electrically conductive plate and a second outer electrically conductive plate, each having an inside face;

a first electrically insulating plate and a second electrically insulating plate, the first electrically insulating plate adjacent to the first outer electrically conductive plate inside face, and the second electrically insulating plate adjacent to the second outer electrically conductive plate inside face; and an inner electrically conductive plate disposed between the first electrically insulating plate and the second electrically insulating;

wherein the first outer electrically conductive plate is electrically connected to the second outer electrically conductive plate.

12. The electromagnetic pulse device of claim 1 further comprising a non-magnetic insulation component disposed at least partially around the conductive coil and the one or more plasma discharge devices.

13. The electromagnetic pulse device of claim 1 further comprising a stability-enhancing component at least partially surrounding the electromagnetic pulse device.

14. The electromagnetic pulse device of claim 1 further comprising one or more additional electromagnetic pulse devices, wherein each additional electromagnetic device is activated by current generated from another of the one or more electromagnetic devices.

15. The electromagnetic pulse device of claim 14 wherein current from any one of the electromagnetic pulse devices, including the original and additional devices, activates a plurality of the electromagnetic pulse devices.

16. The electromagnetic pulse device of claim 1 further comprising one or more additional electromagnetic pulse devices cascaded with the original electromagnetic device.

17. The electromagnetic pulse device of claim 1 further comprising one or more additional electromagnetic pulse devices, wherein one or more of the devices, including the original device and the additional devices, are activated in parallel.

18. The electromagnetic pulse device of claim 1 further comprising a parabolic reflector positioned so that radiation is emitted from the electromagnetic pulse device substantially at the focus of the parabolic reflector.

19. The electromagnetic pulse device of claim 1 further comprising explosive material.

20. The electromagnetic pulse device of claim 1 further comprising:

a conductive component functionally connected to the electromagnetic pulse device to provide a ground return path for a triggering device.

21. The electromagnetic pulse device of claim 20 wherein the conductive component is a core disposed within, and spaced apart from the conductive coil.

22. The electromagnetic pulse device of claim 21 wherein the conductive component is metallic.

23. The electromagnetic pulse device of claim 22 wherein the conductive component is iron.

24. The electromagnetic pulse device of claim 20 wherein the conductive component is external to the device.

25. The electromagnetic pulse device of claim 1 wherein one or more components are superconductive.

26. The electromagnetic pulse device of claim 25 wherein the coil is superconductive.

27. The electromagnetic pulse device of claim 1 wherein the plasma discharge devices are activated simultaneously.

28. A method of generating an electromagnetic pulse without use of an explosive comprising:

providing a conductive coil;

applying a current to the conductive coil to produce a magnetic field; and shorting the conductive coil with one or more electro-discharge devices.

29. The method of claim 28 wherein the plasma discharge devices are activated simultaneously.

* * * * *